US005127672A

United States Patent [19]

Horibata

[11] Patent Number: 5,127,672

[45] Date of Patent: Jul. 7, 1992

[54] HOPPING ROLLER SKATE OR SKI

[76] Inventor: Hiroshi Horibata, Mitaka House, No. 25-20, 5-Chome, Kamirenjaku, Mitaka-shi, Tokyo 181, Japan

[21] Appl. No.: 551,950

[22] Filed: Jul. 12, 1990

[51] Int. Cl.[5] ..... A63C 17/00

[52] U.S. Cl. ..... 280/842; 280/11.14; 280/11.2; 280/87.042

[58] Field of Search ..... 280/842, 11.19, 11.115, 280/11.2, 11.21, 11.27, 11.28, 11.3, 11.14

[56] References Cited

U.S. PATENT DOCUMENTS

| | | | |
|---|---|---|---|
| 499,052 | 6/1893 | Storla | 280/11.115 |
| 1,587,749 | 6/1926 | Bierly | 280/11.115 |
| 2,048,916 | 7/1936 | Bentzlin | 280/11.2 |
| 2,418,703 | 4/1947 | Ferrara | 280/11.28 |
| 2,557,331 | 6/1951 | Wintercorn | 280/11.28 |
| 3,219,358 | 11/1965 | Hagner | 280/11.14 |
| 3,722,900 | 3/1973 | Dickert | 280/842 |
| 4,298,209 | 11/1981 | Peters | 280/11.2 |
| 4,351,538 | 9/1982 | Berta | 280/11.28 |
| 4,700,958 | 10/1987 | Volpato | 280/842 |
| 4,943,075 | 7/1990 | Gates | 280/842 |

FOREIGN PATENT DOCUMENTS

| | | | |
|---|---|---|---|
| 959743 | 10/1949 | France | 280/842 |
| 965589 | 9/1950 | France | 280/842 |
| 1525328 | 5/1968 | France | 280/11.115 |

*Primary Examiner*—David M. Mitchell
*Attorney, Agent, or Firm*—Bernard Olcott

[57] ABSTRACT

A hopping roller skate comprises a hopping shoe, which comprises a shoe and a pair of coil springs with or without an elastic base plate, combined with a fixed or releasable roller skate body, and is used for the training of skiing or cross-country skiing. When separated the hopping shoe and roller skate may each function in their usual and ordinary manner, respectively. The arrangement of the rollers under the skate body may be selected in accordance with the desired training for the sport. Stability for a wearer on the coil springs is maintained with a pair of sticks. The extreme outer coils of the springs arranged outwardly on the roller skate are at a right angle to a respective longitudinal axis. The sticks and the coil springs accelerate the sliding speed of the skate by their stroke or thrust movement, and change the sliding direction in the same manner as an ordinary ski. Front and rear brakes control the movement and sliding speed by contact friction with the ground.

16 Claims, 4 Drawing Sheets

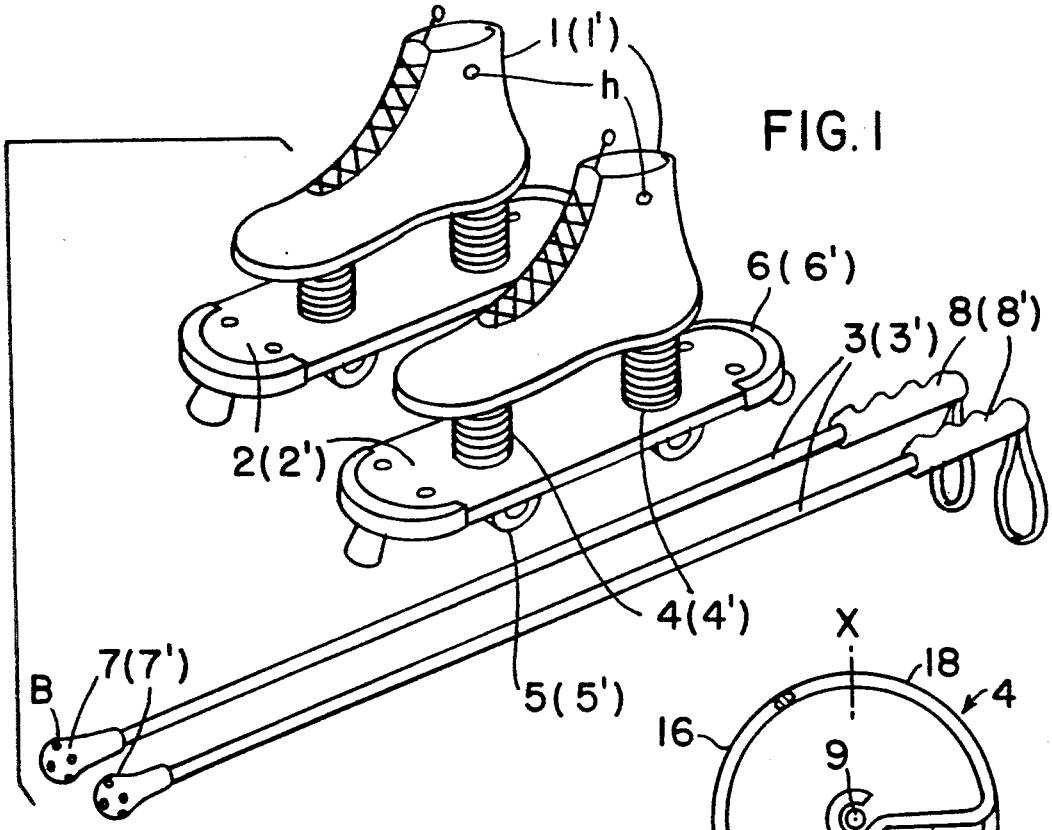
FIG. 1
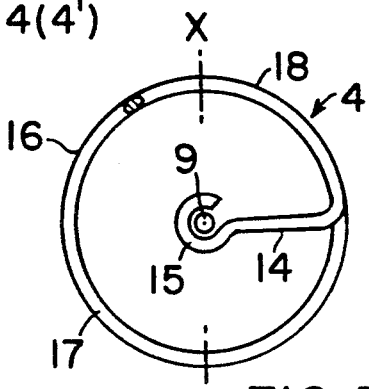
FIG. 3
FIG. 2
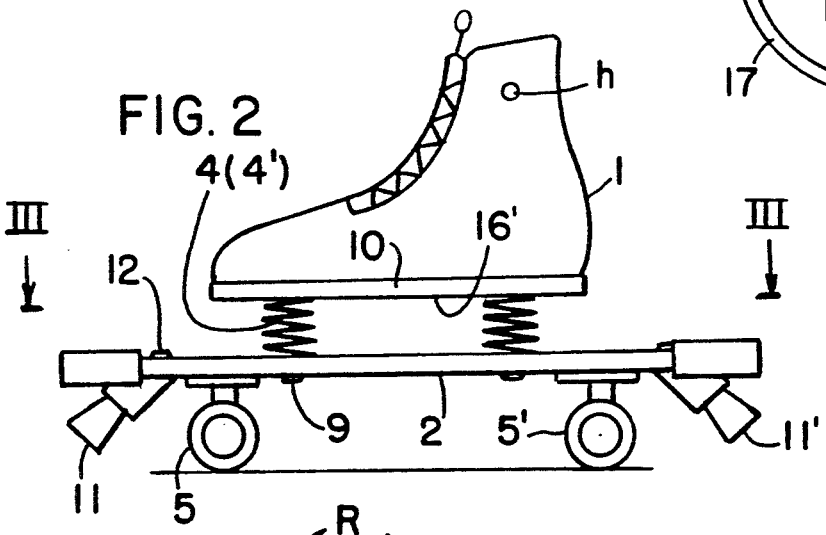
FIG. 6
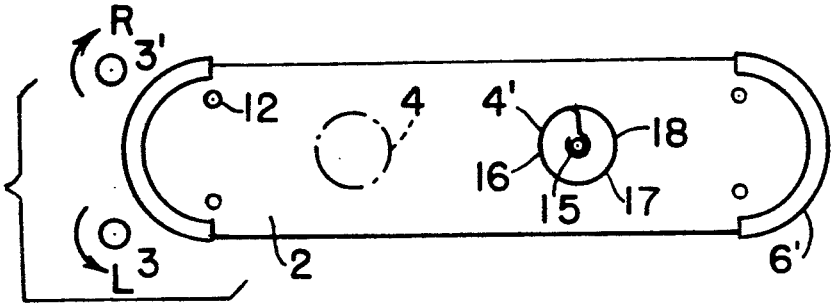

FIG. 10
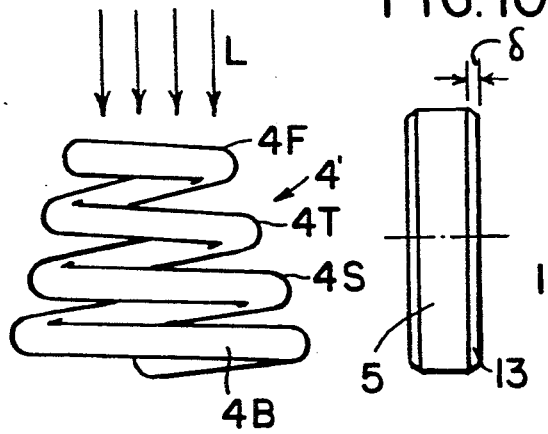
FIG. 5
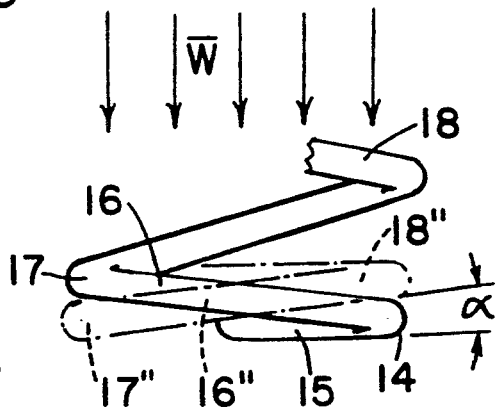
FIG. 4
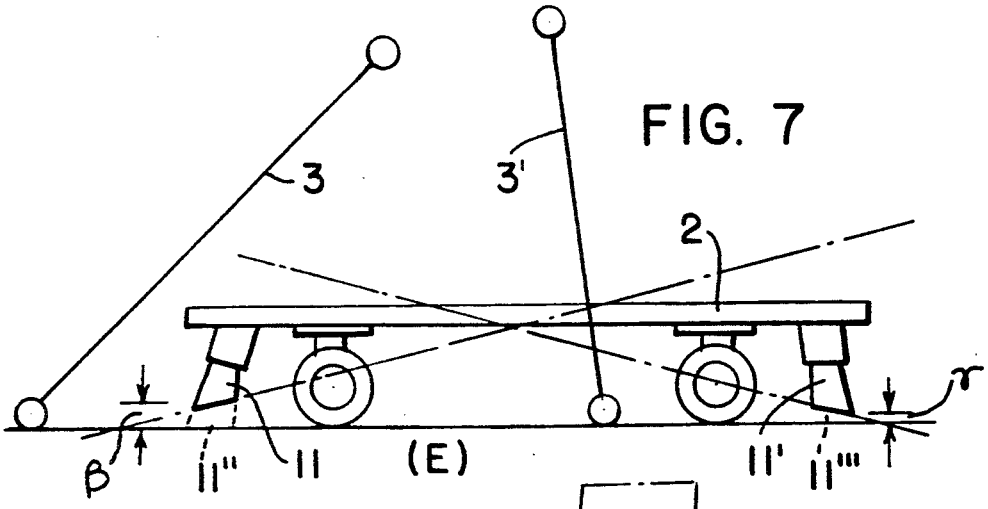
FIG. 7
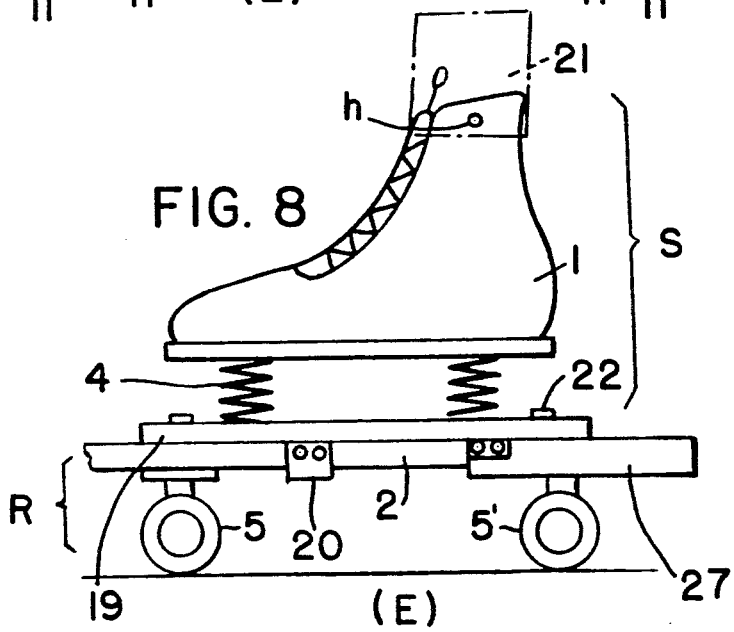
FIG. 8

FIG. 11
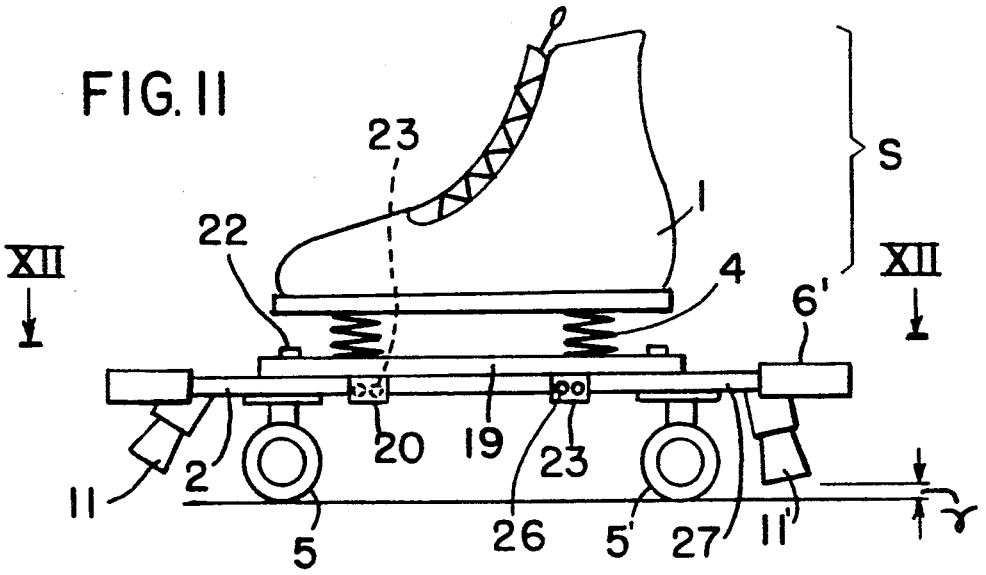
FIG. 12
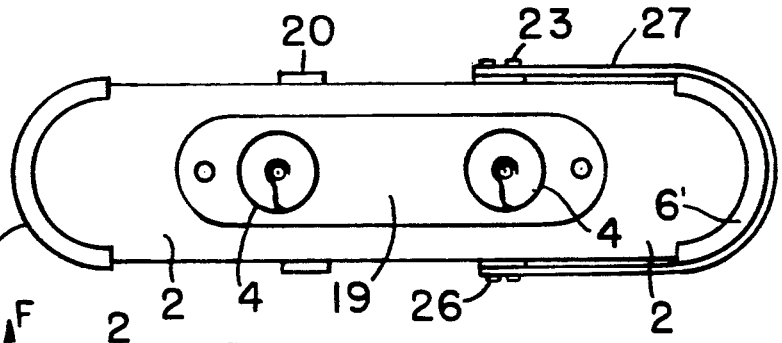
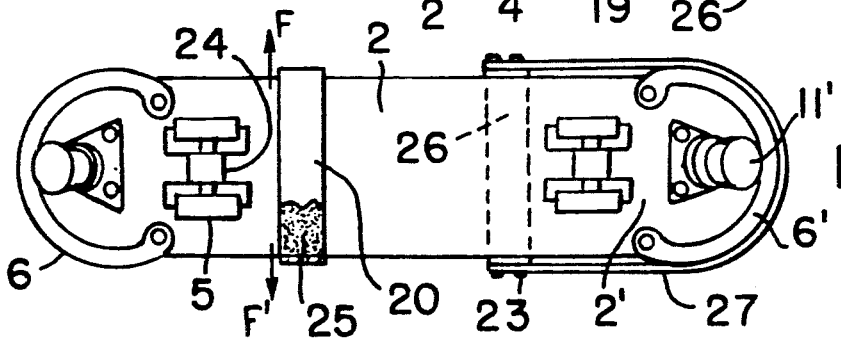
FIG. 13
FIG. 14
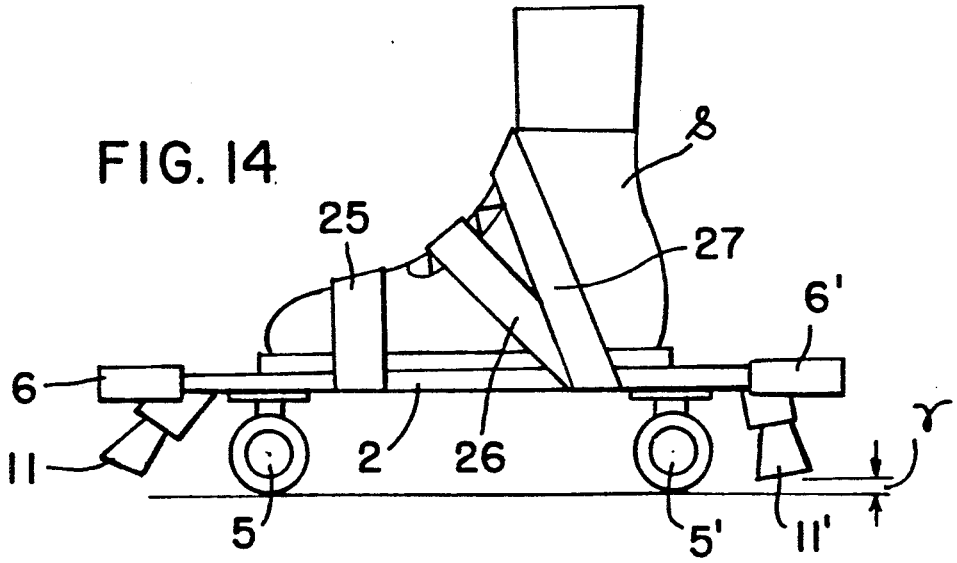

HOPPING ROLLER SKATE OR SKI

FIELD OF THE INVENTION

This invention relates to a hopping roller skate or roller ski which creates a new sports category by the combination of a pair of hopping shoes, roller skate or ski and stick.

BACKGROUND OF THE PRESENT INVENTION

Recently, the roller skate or skate board has been in fashion with young men, and the hopping shoe, suggested in U.S. Pat. No. 4,457,084 to shape up the body or to dance to various rhythms. The hopping shoe, however, is inferor to the skate and skate board in its speed and thrilling movements, and therefore decreases the fun of play.

SUMMARY OF THE PRESENT INVENTION

A hopping roller skate comprises a hopping shoe, which comprises a shoe /and a pair of coil springs with or without an elastic base plate, combined with fixedly or separately a roller skate body, and is used for the training of skiing or cross-country skiing after the closed season. When separated the hopping shoe and roller skate may each function in their usual and ordinary manner, respectively.

The arrangement of the rollers under the roller skate body may be selected in accordance with the desired training for the sport, such as skating or skiing.

Stability for a wearer on the coil springs is maintained with a pair of sticks combined into one set of the hopping roller skates. The extreme outer coils of the spring arranged outwardly on the roller skate are at a right angle to a respective longitudinal axis. The sticks and the coil springs accelerate the sliding speed of the hopping roller skate by their stroke or thrust movement, and change technically the sliding direction in the same manner as an ordinary ski.

Front and rear brake means control the movement and sliding speed by contact friction with the ground.

It is an object of the present invention to provide a novel sporting goods for the enjoyment of ski or skate-like sports under relative safe conditions, without snow and slope of the land.

It is an another object of the present invention to provide, in combination, an additional hopping action of the sporting goods by coil springs attached between the shoe and skate body, upon it's sliding.

It is another object of the present invention to provide a front and rear brake means underneath the skate body to stop and slow-down the sporting good by forced friction between the broke means and the ground.

It is a further object of the present invention to prevent a sprain of the ankle of wearer by special arrangement of the coil springs on a center line of the skate body.

It is a further object of the present invention to provide another novel sporting goods comprising a pair of hopping shoes, roller skates and sticks which can be separated into the hopping shoes and the generally usual skate respectively, by releasing the bolts and nuts on the skate body.

It is still an other object of the present invention to provide in combination a sporting goods and a leg-warmer or leg band to warm the ankle for prevention of the sprain.

BRIEF DESCRIPTION OF THE DRAWINGS

FIG. 1 is a perspective view of a pair of hopping roller skate.

FIG. 2 is a front view of a hopping roller skate.

FIG. 3 is a partial plan view of a coil spring used in the present hopping roller skate.

FIG. 4 is a partial front view of the coil spring in FIG. 3 and shows a transformation of the coil spring upon loading.

FIG. 5 is a front view of helixol coil spring used in the present hopping roller skate.

FIG. 6 is a plan view of the skate body and shows an arrangement of the coil springs thereon.

FIG. 7 is a functional view of a front or rear brake means during the skating.

FIG. 8 is a front view of another embodiment of the present invention.

FIG. 10 is a front view of a roller for the present hopping roller skate.

FIG. 11 is a front view of a hopping roller skate having three pieces of elastic belts for binding to an original shoe after separation of the hopping roller skate.

FIG. 12 is a sectional plan view through a line XII—XII in FIG. 11.

FIG. 13 is a bottom view of the hopping roller skate in FIG. 11, and

FIG. 14 is a front view of a skate with the original shoes used on the roller skate body of the present hopping roller skate in FIG. 11.

DETAILED DESCRIPTION OF THE PREFERRED EMBODYMENTS

Figure 9A:
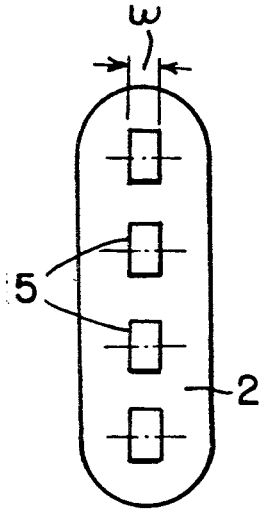
FIG. 9*a–i* are arrangements of the rollers in verious embodiments of the present invention.
Figure 9B:
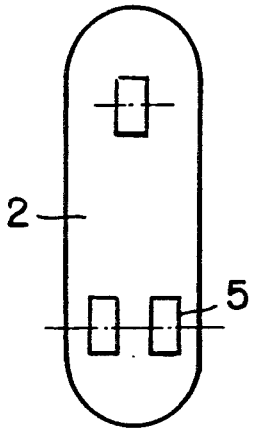
Figure 9C:
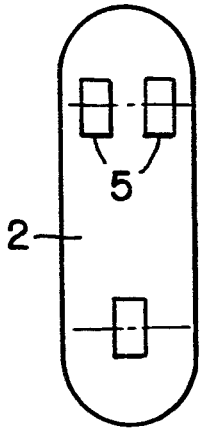
Figure 9D:
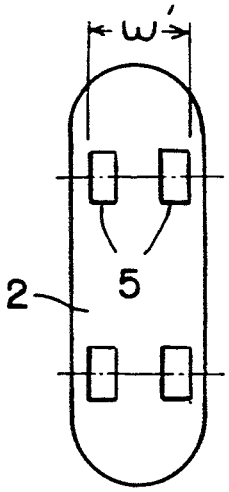

Referring now to the drawings and particularly FIGS. 1 and 2, a pair of hopping roller skates is illustrated in combination with a pair of shoes (1)(1') attached on a pair of roller skate bodies (2)(2') through two pairs of coil springs (4)(4') and a pair of sticks (3)(3').

The shoes (1)(1') are also attached on uppermost coil spring pieces (16)(16') through their shoes soles (10, 10'), and the roller skate bodies (2)(2'), under lower most coil spring pieces (16)(16'), by means of bolts and nuts (9)(9') respectively.

Underneath roller skate bodies (2)(2') are provided at least two rollers (5)(5') with the front and rear brake means or stoppers (11)(11'), which is respectively described in detail hereinafter, the brake means (11)(11') being attached by a bolt and nut (12) and sealed preferable with plastic cement thereon, and a front and rear plastic protector (6)(6').

The sticks (3)(3') comprise a metal pole, for example, of stainless steel etc. and includes an elastic protector (7)(7') at one end, so as not to injure another player, and to prevent slippage when it strikes the ground, and an elastic grip (8)(8') at the end respectively. The elastic protectors (7)(7') and grips (8)(8') may be selected from a group of plastic material, rubber material, leather material and the like.

The coil springs (4)(4') of the present hopping roller skate may be cylindrial or helicol coil spring, and may have sufficient dimensions so that the wearer is steady on it during skating and thrusting.

The coil springs (4)(4'), are formed from a steel wire of suitable dimension and so composed that the uppermost and lowermost coil spring pieces (16)(16') partially form a central elongated portion (14)(14') providing an outer axial and centrally extending ends (15)(15').

The shoe sole (10) and roller skate body (2) are respectively firmly connected by a bolt-nut means (9) through the outer axial and centrally extending ends (15)(15'), as described hereinbefore, and the two outermost coil pieces (16)(16') are made to almost contact with the shoe sole (10) and roller skate body (2).

In this connection, the central elongated portions (14)(14') of the coil springs (4)(4') are outwardly arranged to fall at right angles with an axis line (X—X) on the roller skate body (2), as shown in FIGS. 3 and 6.

This arrangement toward an outside (0) of the skate body (2), as shown in FIG. 4, prevents ankle sprain, owing to avoidance of an outward twist of the ankle resting at ($\alpha$) degrees inwardly of a coil spring piece (17) which is in a higher winding position from the lowermost coil spring piece (16), against the central elongated portion (14) and a partial portion of the lowermost coil spring piece (16), when the pressure or load (W) is added on the coil spring (4) during the skating.

Contrarily, an inward arrangement of the central elongated portion (14)(14') of the coil spring (4) or (4') causes a sprain because the ankle tends to twist outwardly, when resting at the degrees outwardly of the coil spring pieces (17).

As shown in FIG. 5, the coil spring is used advantageously in the form of helicol coil spring (4') to prevent the metallic sound caused by contact of an upper and lower spring pieces and maintains balance of the wearer on the hopping shoes, during the thrust or hopping action.

In the helicol coil spring (4'), and spring piece (4F)(4T) and (4S) is respectively compressed into a lower spring piece. This arrangement prevents generation of the metallic sound and ankle sprain and provides a smooth elastic movement when a load (L) is added by thrusting or hopping the roller skate (2).

A lowermost helicol coil spring piece (4B) gives more stability to the hopping shoe than the usual cylindrical coil spring (4) because all spring pieces (4F)(4T)(4S)(4B) do not pile up but are compressed into each other respectively.

The rollers (5) of the present hopping roller skate may be made of plastic or steel, however, the former is preferable in view of economy and noise, the edge (13), as shown in FIG. 10, may also be rounded to make a quick change in direction of sliding.

The roller (5) have also many arrangements underneath the roller skate body (2), as shown in FIG. 9, according to the use for the present skate.

Figure 9E:
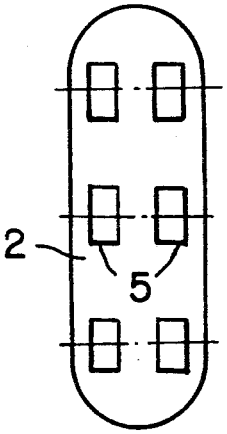
Figure 9F:
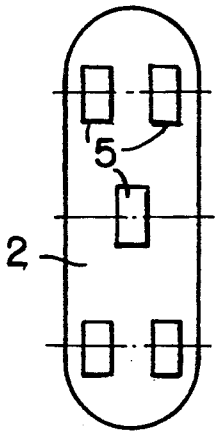

The roller arrangements in FIGS. 9*a*, and 9*f* are respectively for a training ski in the off-season. The arrangements, in FIGS. 9*b*, 9*c*, 9*d*, 9*g*, 9*h* and 9*i* are respectively for a roller skate with or without the sticks.

In operation, the hopping roller skate or ski (2) is advanced not only in the same manner is a roller skate but also by a stroke in the manner of a cross-country ski.

The skate (2) can also change its side direction toward the right (R) or left (L), as shown in FIG. 6, by striking the sticks at a left or right front or against the ground.

The hopping roller skate (2) has a series of rollers or a narrow double line rollers, as shown in FIG. 9*a* or FIG. 9*e*, to enable a change in sliding direction by inclining outwardly the skater's weight toward one side of a pair of skates.

In addition, the roller skate (2) speed is controlled by friction of the front or rear brake means (11) or (11') with the ground (E). The friction is caused by inclination of the skate body toward the front or rear position (11'') or (11''') as shown in FIG. 7, to make contact with the ground of both brake means (11) or (11'). The brake action during the sliding preferably should be by the rear brake means (11') because the front brake means (11'') may cause the skater to fall forward due to kinetic inertia, and even make a forward somersault if the inertia is too large to stop the skate (2). However, the sticks (3), (3') may be used to reduce forward inertia to prevent the somersault of the skater.

A hopping roller skate in FIGS. 8, 11 to 13 comprises a hopping shoe (S) and a roller skate (R), the hopping shoe(S) including a shoe (1), coil springs (4) and an elastic base plate (19). The roller skate or ski comprising a roller skate body (2), rollers (5) and three belt means (20), (27), (26) wherein the hopping shoe (S) is detachable from the roller skate (R) by releasing the bolt and nut means (22) from the skate body (2).

The hopping shoes (S), on the other hand, may be bound by means of belts (not shown) in some portions on the roller skate body (2) with the elastic base plate (19), in place of the bolts and nuts. Therefore, the separated hopping shoe (S) and hopping roller skate (R) can be used individually.

It is also advantageous to use a leg-warmer or a leg band (21) combination with the hopping shoe (S) for warming the ankle because a warmed ankle prevents sprain due to softening the muscles thereof.

The roller skate body (2) provides generally three belts (20)(27) (26) attached on both sides by means of bolts (23)(23'), as shown in FIGS. 11 to 13.

The belts (20) and (26) are respectively placed under and over the roller skate body (2) respectively. Belt 20 comprises two pieces of fastener tape to bind a front portion of the original shoe or sports shoe as shown at (25) by pulling up in the direction (F) (F') toward the upper surface of the skate body (2) the male and female fastener tape surfaces. After taking off the hopping shoe by releasing the bolts 22, and positioning the belts 26, 27 on an ankle and instep, as shown in FIG. 14, the shoe may be used as a roller skate.

The belts (26) and (27) are respectively attached to the same bolts (23) on both sides of the skate body (2), and the former is covered under the elastic plate (19) of the hopping shoe to give a cushion against the hopping shocks on the skate body (2).

The latter belt (27) is also covered by stretching backward on the rear protector (6'), when the skate body (2) is used as a hopping roller skate. All belts (20), (26), (27) are preferably colorful, as is customary in the sporting world.

Additionally, the rear break means (11') preferably should be used when sliding on a slope and may have a smaller surface angle ($\gamma$) than the front break means surface angle ($\beta$) because the skate body (2) should not be excessively inclined to avoid a rear somersault the slider or player.

The elastic protector (7) or (7') of the stick (4) may provide a distorted portion (B) on its surface to prevent a slip when used.

The roller skate body (2) has also various arrangements of the rollers such as a series or double lines underneath it, as shown in FIG. 9.

Figure 9G:
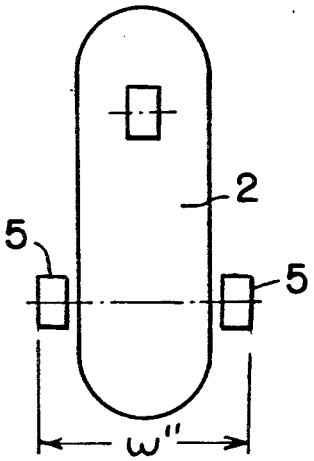
Figure 9H:
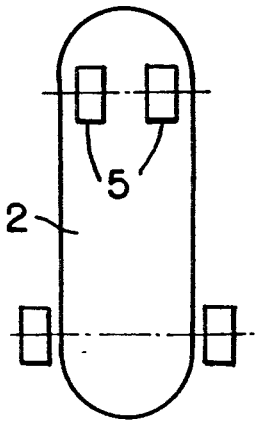
Figure 9I:
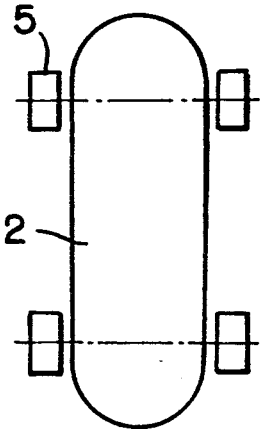

The width (W) or (W') of the arrangements is generally narrower than the width of the roller skate body (2), however, the embodiment in FIGS. 9*g*, 9*h* and 9*i* provide a broader width (W'') than the roller skate (2).

The former arrangements are suitable for use in ski training during the closed season or the glass ski, and the latter, for the beginner's skate or the skateboard with or without the sticks, because the former is capable of small sharp turns and the latter is stable when sliding.

The former arrangements of course are also capable of use as a roller skate or a skate board. Furthermore, the roller (5) itself may also have a wide or narrow width according to the purpose of usage or to the width of the arrangements, as mentioned before.

While there has been described and pointed out the fundamental novel features of the invention as applied to prefered embodiments, it will be understood that various omissions and substitutions and changes in the form and details of the devices illustrated and its operation may be made by those skilled in the art, without departing from the spirit of the invention.

The invention, therefore, is limited only as indicated by the scope of the following claims:

I claim:

1. A hopping roller skate comprising, in combination:

a shoe member;

a roller skate body spaced from the shoe member;

front and rear brake means disposed under the body, the brake means each having substantially the same inclined surface for ground engagement, the angle of the rear inclined surface being smaller than the angle of the front inclined surface;

a plurality of roller means disposed under the body, the roller means having rounded edges;

coil springs disposed between the shoe member and the body, an uppermost and lowermost circular end of each coil spring being attached through a central elongated portion to the shoe member and the body, respectively, the central elongated portion arranged to be at a substantially right angle to a longitudinal axis of the body;

protector means on front and rear ends of the body;

a plurality of belt means secured to sides of the body, including first and second belt means secured to opposite sides of the body for extending over the body, third belt means placed on both sides of the body and around the rear protector by extending the third belt means rearwardly from a secured position on the second belt means; and at least one stick means having on a least one end thereof a covering of an elastic material.

2. The skate according to claim 1 comprising an elastic base plate disposed between the coil springs and the skate body, the coil springs being attached to the elastic base plate wherein the lowermost circular end of the coil is attached to the plate and the uppermost circular end of the coil is attached to the shoe member.

3. The skate according to claim 2 wherein the first and second belt means can be engaged to each other and the third belt means is elastic.

4. The skate according to claim 2 wherein the uppermost coil end is circularly smaller than the lowermost circular coil end.

5. A skate according to claim 1 wherein the coil spring is a cylindrical coil spring.

6. A skate according to claim 1 wherein the coil spring is a helical coil spring.

7. A skate according to claim 1 wherein the first and second belt means can be engaged to each other and the third belt means is elastic.

8. A skate according to claim 1 wherein the width and length of the body is greater than the width and length of the shoe member.

9. A skate according to claim 1 wherein the rollers are arranged in series underneath the body.

10. A skate according to claim 1 wherein the rollers are arranged at least in two lines within the width of the body.

11. A skate according to claim 1 wherein the rollers are arranged in two lines broader than the width of the body.

12. A skate according to claim 1 wherein the rollers are arranged differentially at the front and rear portions of the skate.

13. A hopping roller skate according to claim 1 wherein rollers are arranged in series underneath the skate body.

14. A hopping roller skate according to claim 1 wherein the rollers are arranged at least in two lines within the width of the roller skate body.

15. A hopping roller skate according to claim 1 wherein the rollers are arranged in two lines broader than the width of the roller skate body.

16. A hopping roller skate according to claim 1 wherein the rollers are arranged differentially at the front and rear portions of the roller skate.

* * * * *